US005108587A

United States Patent [19]

Walker

[11] Patent Number: 5,108,587

[45] Date of Patent: Apr. 28, 1992

[54] APPARATUS FOR THE ELECTRODYNAMIC SEPARATION OF NON-FERROMAGNETIC FREE-FLOWING MATERIAL

[76] Inventor: Erik K. Walker, 2570 S. Dayton Way-Apt, I201, Denver, Colo. 80231

[21] Appl. No.: 429,068

[22] Filed: Oct. 30, 1989

[51] Int. Cl.[5] ..... B03C 1/23; B03C 1/26

[52] U.S. Cl. ..... 209/212; 209/220; 209/227; 209/231

[58] Field of Search ..... 209/212, 219, 220, 225-228, 209/231

[56] References Cited

U.S. PATENT DOCUMENTS

| | | | |
|---|---|---|---|
| 1,024,109 | 4/1912 | Troy | 209/212 |
| 1,371,301 | 3/1921 | Converse | 209/219 |
| 3,448,857 | 6/1969 | Benson et al. | 209/212 |
| 3,892,658 | 7/1975 | Benowitz | 209/219 X |
| 4,003,830 | 1/1977 | Schloemann | 209/212 X |
| 4,238,323 | 12/1980 | Zakharova et al. | 209/212 |
| 4,313,543 | 2/1982 | Paterson | 209/212 |
| 4,743,364 | 5/1988 | Kyrazis | 209/212 |

FOREIGN PATENT DOCUMENTS

| | | | |
|---|---|---|---|
| 3416504 | 11/1985 | Fed. Rep. of Germany | 209/212 |
| 1313509 | 5/1987 | U.S.S.R. | 209/212 |

*Primary Examiner*—Michael S. Huppert
*Assistant Examiner*—Edward M. Wacyra
*Attorney, Agent, or Firm*—Rothgerber, Appel, Powers & Johnson

[57] ABSTRACT

Electrodynamic separation of non-ferromagnetic, free-flowing materials, in which at least one component of the material to be processed is electrically conductive, whereby such material is caused to free-fall into a region of space permeated by time and space varying magnetic fields which induce eddy currents in the electrically conductive particles which produce forces on such particles that result in substantially different free-fall trajectory than that of nonconductive particles. Conductive particles are separated on the basis of mass, electrical conductivity and magnetic susceptibility. The time and space varying magnetic fields are generated by a plurality of permanent magnets or electromagnets attached to a rotor assembly such that the polarity of adjacent magnets is caused to reverse so that rotation of the rotor assembly generates magnetic fields which may vary in time and space to the maximum extent.

8 Claims, 7 Drawing Sheets

APPARATUS FOR THE ELECTRODYNAMIC SEPARATION OF NON-FERROMAGNETIC FREE-FLOWING MATERIAL

Let it be known Erik Keith Walker has conceived of a novel and unique method of extracting non-ferromagnetic, conductive particles of metals from non-ferromagnetic, nonconductive host materials utilizing magnetic fields which may vary in time and space. The time and space varying magnetic fields induce electrical currents called eddy currents in the conductive metal particles which, in the presence of the magnetic fields, produces a force on such conductive particles. The force acting on the conductive particles causes such particles to accelerate in a direction substantially different from the nonconductive component particles when the material to be processed is caused to free-fall into a region of space in which the time and space varying fields are present.

The different free-fall trajectory of the electrically conductive particles relative to the nonconductive particles may be utilized to advantage in the segregation of the conductive particles. Furthermore, the conductive particles so segregated may be classified or further separated on the basis of density, electrical conductivity and magnetic susceptibility.

BACKGROUND OF THE INVENTION

1) Field of the Invention

The present invention relates to the art of separating free-flowing, non-ferromagnetic, conducting materials from non-ferromagnetic, nonconducting free-flowing materials, such materials being mixed together, by virtue of electrical conductivity, magnetic susceptibility and density.

The invention is particularly well suited for processing placer deposits of free-flowing auriferous metal(s) ores in the industry. Auriferous particles in placer geological deposits may be effectively and efficiently separated from the sand and gravels in which they naturally occur.

2) Description of the Prior Art

The methods of segregating non-ferromagnetic, conductive, free-flowing materials from non-ferromagnetic, nonconductive materials fall into one of three categories:

1. high tension
2. heavy media
3. eddy current

The present invention is of the eddy current type. It is common knowledge that a time varying magnetic field will induce electrical currents in conducting materials within the influence of such magnetic fields. It is also known that if a magnetic field moves with respect to an electrically conductive body, or vice versa, electrical currents are induced in a conducting body. In the latter case, the eddy currents induced in the conducting body and their interaction with the magnetic field that produced them, produce forces which accelerate the conducting body in the direction of the moving magnetic field.

A prior art method and apparatus is exemplified in U.S. Pat. No. 4,003,830. The separation apparatus comprises a planar area array of permanent magnets arranged to form alternating strips of north and south polarity. The material to be processed is caused to slide down an incline plane over the planar array of magnets such that the conductive particles in said material will have induced electrical currents flowing within them and the attendant electromagnetic forces cause the conducting particles to be separated from the nonconductive particles.

Another method of the prior art is exemplified in U.S. Pat. No 4,238,323. According to this method, the flow of material to be processed is caused to free-fall into a region of space permeated by a non-uniform magnetic field. The non-uniform magnetic field is created by a magnetic circuit composed of a "C" shaped ferromagnetic pale piece with a beveled surface on each pale piece face. Non-ferromagnetic material, comprised of both conductive and nonconductive material, is caused to free-fall into the region of space between the above pole pieces. Eddy currents are induced in the conducting particles as in similar methods and such currents interact with the magnetic field generated by the above magnet such that the conducting particles move from the region of highest field intensity to lowest field intensity. The free-fall trajectory of the nonconducting particles is unaffected by the presence of the magnetic field.

Both of the above inventions are not particularly well suited for the processing of auriferous materials because neither apparatus is capable of processing sufficiently large volumes of material for a substantial profit. The apparatus described in U.S. Pat. No. 4,003,830 utilizes permanent magnets. Such magnets are adequate for the separation of light metals of the non-ferromagnetic type, such as aluminum, from municipal waste. However, such an apparatus utilizes permanent magnets which are far less powerful than electromagnets and therefore cannot generate sufficient field strength to extend sufficiently far from the surface of the inclined plane to permit the processing of large volumes of material. Furthermore, said apparatus in U.S. Pat. No. 4,003,830 would have severe maintenance problems associated with the abrasive destruction of the inclined plane surface over which the auriferous material would flow. Further still, the inclined plane of the above apparatus intrinsically is a lower throughput device than a free-fall device. The apparatus described in U.S. Pat. No. 4,238,323 utilizes electromagnets which are capable of extending a considerable distance from one pole to the other. However, said apparatus relies upon the relatively narrow volume of space permeated by the region of high magnetic field intensity. Again the result is an apparatus which is capable of processing only laboratory scale volumes of material. In a typical mining operation, the above apparatus would not be practical. Furthermore, were the above apparatus to be scaled up in size, it would consume large amounts of power to effect separation of an impractically small amount of material.

OBJECTS OF THE INVENTION

An object of the present invention is to provide a method of and apparatus for the electrodynamic separation of non-ferromagnetic, free-flowing conductive materials from the nonconductive material components at substantially higher throughput rates than the prior art. Such higher throughput rates make the processing of placer auriferous metal deposits practical and profitable.

A further object of the present invention is to effect the segregation of non-ferromagnetic, conductive materials from the nonconductive component at substantially lower power consumption levels than the prior art. Significantly lower power levels result in significantly lower operating costs in a mining operation which, in turn, results in higher profits.

Yet another object of the invention is to provide a method of and apparatus for the segregation of non-ferromagnetic, conductive precious metals on the basis of magnetic susceptibility, conductivity and density. Such separation is effected by the present invention at substantially lower power consumption levels and higher throughput rates than the prior art.

SUMMARY OF THE INVENTION

The above and other objects are attained by a method for electrodynamic separation of non-ferromagnetic, free-flowing materials, based on the interaction between the time and space varying magnetic fields and the electrical currents such fields induce in the conducting particles being separated by the electromagnetic forces which result from said interaction. It includes the feed of a flow of material into a region of space permeated by the time and space varying magnetic fields. That is, the material to be separated is directed into a region of space in which magnetic fields vary with respect to time and space to the maximum extent. Non-ferromagnetic, conductive particles or bodies commingled in the material being processed by the time and space varying fields, are accelerated by the electromagnetic forces acting on said particles or bodies as a result of the interaction between the eddy currents flowing in said particles or bodies and the time and space varying fields. Said forces substantially deflect the free-fall trajectory of the non-ferromagnetic, conductive particles or bodies from the free-fall trajectory of the nonconductive material, thereby effecting the separation. Accordingly, a chute or plurality of such chutes, which are divided into two regions by a partition direct, segregate and contain the separated material(s).

In the present invention, it is preferable to create magnetic fields which vary with respect to time and space simultaneously by causing a vertically oriented cylindrical tower of electromagnets to rotate on its vertical or longitudinal axis, and whereby electromagnets are attached to the outer surface of said cylindrical tower such that rotation of said tower causes the magnetic field associated with each electromagnet to sweep through 360 degrees of arc. The magnetic field associated with each electromagnet on the surface of said tower is caused to be directed in the radial direction, either, inward or outward depending on the polarity of said electromagnets. Furthermore, the polarity of said electromagnets is made to alternate from one row of electromagnets on the surface of the cylinder to another.

It is preferable, but not necessary, to uniquely and unusually wind the electromagnets which generate the radially directed fields on the surface of said cylindrical tower. It is much more efficient to use a ferromagnetic core member, such as an "I" or "T" beam, such that the windings run in a direction parallel to the longitudinal axis of the beam. Many turns of electrically conductive wire around the entire length of the beam, transform the entire beam into a powerful electromagnet with an essentially uniform magnetic field produced over the beam's entire length. The magnetic field extends outward from or inward into said beam in a direction perpendicular to the longitudinal axis of same. As said beams are attached to the surface of said cylindrical tower such that the longitudinal axis of said beams run in a direction parallel to the long axis of said cylindrical tower, both axes being oriented in a vertical direction, radially directed magnetic fields result.

It is also preferable, but not necessary, to excite said electromagnets with direct current or DC instead of alternating current or AC, because there are no eddy currents generated in the "I" or "T" beam core which waste electrical power. Furthermore, DC will result in considerably greater magnetic field strength than an AC excitation could provide. Further still, a DC excitation transforms the beam core material into a permanent magnet. That is, there is a high residual magnetization created in the beam core material as the result of the DC flowing in the wires wrapped around the beam in the manner described above. The result is the creation of powerful electromagnets which consume substantially less electrical power than if AC were utilized.

The material to be processed is caused to fall into chutes which direct and guide the free-fall at the periphery of rotation of said cylindrical tower of electromagnets and within the influence of the radially directed magnetic fields extending from said cylindrical tower. The material to be processed falls through relatively narrow slits, the longitudinal axis of such slits being radially directed. There is one slit per chute and the chutes are placed symmetrically around the periphery of said cylindrical tower. That is, all the chutes are placed just beyond the circular arc described by the rotation of the cylindrical tower. The inner wall of said chutes being composed of a material that is magnetically transparent and sufficiently thin to permit the magnetic fields produced by said cylindrical tower of electromagnets to permeate the volume of space defined by the interior confines of said chutes. Such a scheme requires only that the time and varying magnetic fields utilized in the separation process deflect the free-fall trajectory of the conductive particles a relatively small amount to effect separation. If, for example, the orifice to the chutes is ½" by 6" a relatively narrow curtain of material to be processed is allowed to fall into the interior of the chutes. If the conductive particles are caused to move say, 2 or 3 inches, in the tangential direction an effective separation will have been accomplished.

The power consumption of the present invention is low compared to the prior art in that the motor or engine which imparts rotary motion to the cylindrical tower of electromagnets due to the considerable inertial mass of said tower. Once said tower is caused to rotate at operational angular velocity, the bearing and air frictional losses are the only forces which said engine or motor must overcome to maintain the rate of rotary motion of said tower.

It is not widely known that in order to produce effectively large deflection forces on auriferous metals, such as naturally occurring electrum, the variation in magnetic field intensity with respect to time and space must exceed a certain minimum threshold valve. Said threshold is directly proportional to the magnetic susceptibility, the density, and the electrical conductivity of the auriferous metal being extracted. The same is true for other precious metals such as platinum. Accordingly, it is preferable to utilize DC excited electromagnets in said tower assembly because such electromagnets more easily generate the magnitude of magnetic field intensity required for the separation of heavy auriferous and/or precious metals. Unlike the prior art, the present invention synergistically utilizes the entire circular arc described by the rotation of the DC excited electromagnet cylindrical rotor assembly to process and segregate said material while taking full advantage of the residual magnetization of the ferromagnetic cores and the stored angular momentum of said tower assembly to perform said segregation with the minimum of power consumption.

BRIEF DESCRIPTION OF DRAWINGS

The manner of attaining the above and other objects will become more apparent from the description of the proposed method for electrodynamic separation of non-ferromagnetic materials, from a detailed example of implementing the method, and also from drawings of the electrodynamic separator, wherein identical parts are denoted by identical reference numerals and wherein.

DETAILED DESCRIPTION OF THE INVENTION

Figure 1:
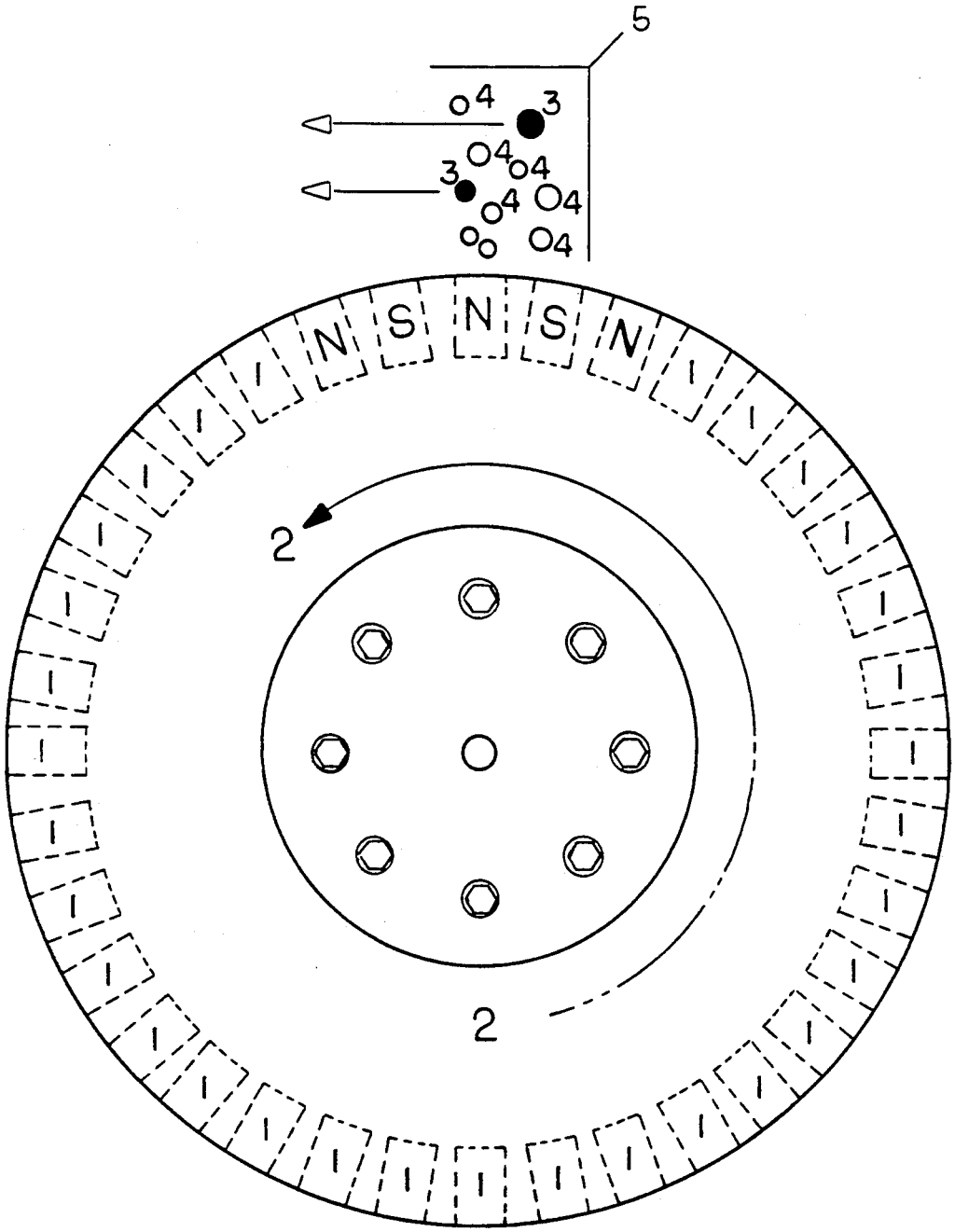
FIG. 1 illustrates the principle of electrodynamic separation of non-ferromagnetic free-flowing materials, according to the invention.

The method of electrodynamic separation herein proposed is most easily comprehended by consideration of FIG. 1. FIG. 1 is a side view of a wheel or disk into which permanent magnets or electromagnets 1 have been embedded. The magnets 1 (FIG. 1) have radially outward or inward directed fields depending on polarity of the magnet's pole facing radially outward, as indicated. Note all of the magnets are shown in (FIG. 1) as it is to be assumed that said magnets are evenly distributed around the entire circumference of the disk as in FIG. 2.

Rotation of the disk (FIG. 1) produces time and space varying magnetic fields relative to electrically conducting particles 3 anywhere said particles are located on the periphery of said disk. In FIG. 1, said conducting particles 3 are located at the top of the disk, but said particles 3 could be anywhere in close proximity to the surface of the disk 2. The interaction of said time and space varying fields produce eddy currents in the conducting particles 3 such that said particles are accelerated in the direction of the arrow. To effect separation, the material to be processed 3 and 4 (FIG. 2) is caused to move in the direction of the arrow (FIG. 2) or substantially parallel to the axis of rotation 5A. The force acting on the electrically conducting particles 3 causes said particles to be accelerated in the direction of disk rotation or out of the plane of the FIG. 2 drawing, while the nonconducting particles 4 continue to move along their original trajectory indicated by one of the arrows.

Figure 2:
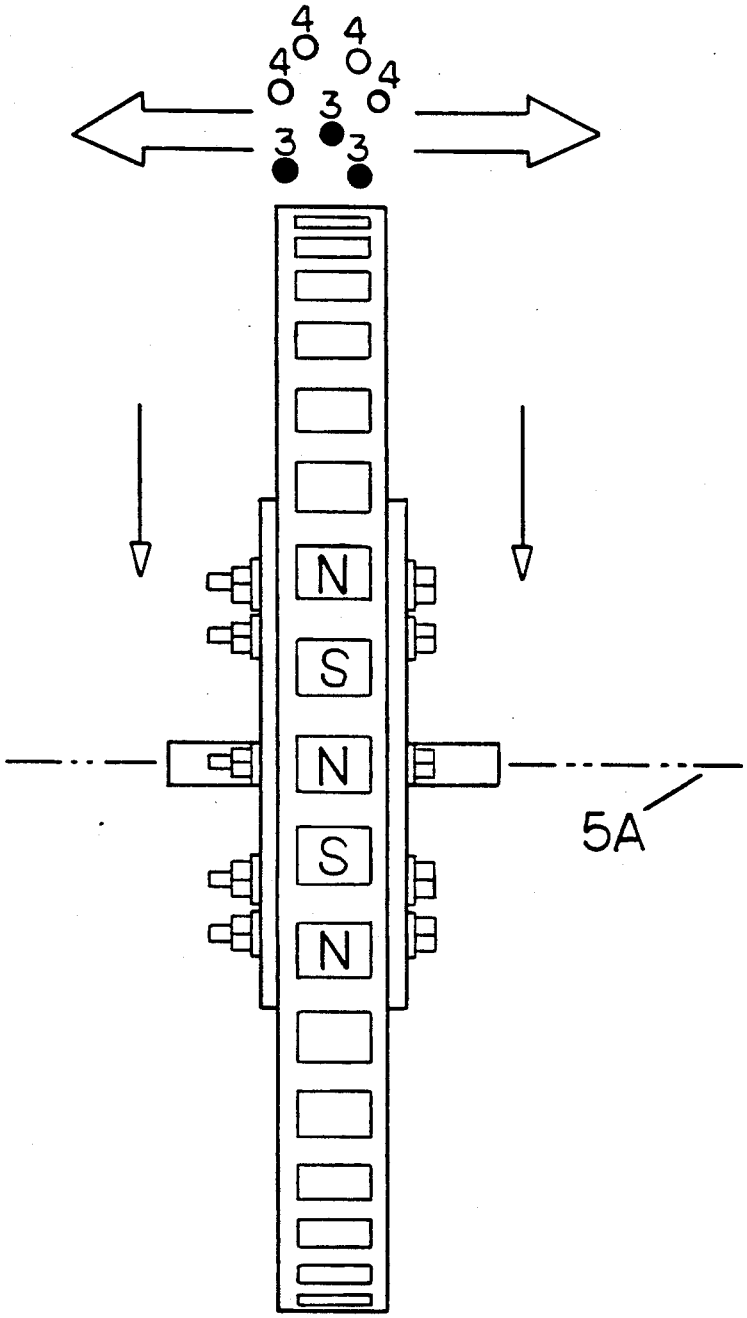
FIG. 2 further illustrates the principles of electrodynamic separation according to the invention.
Figure 3:
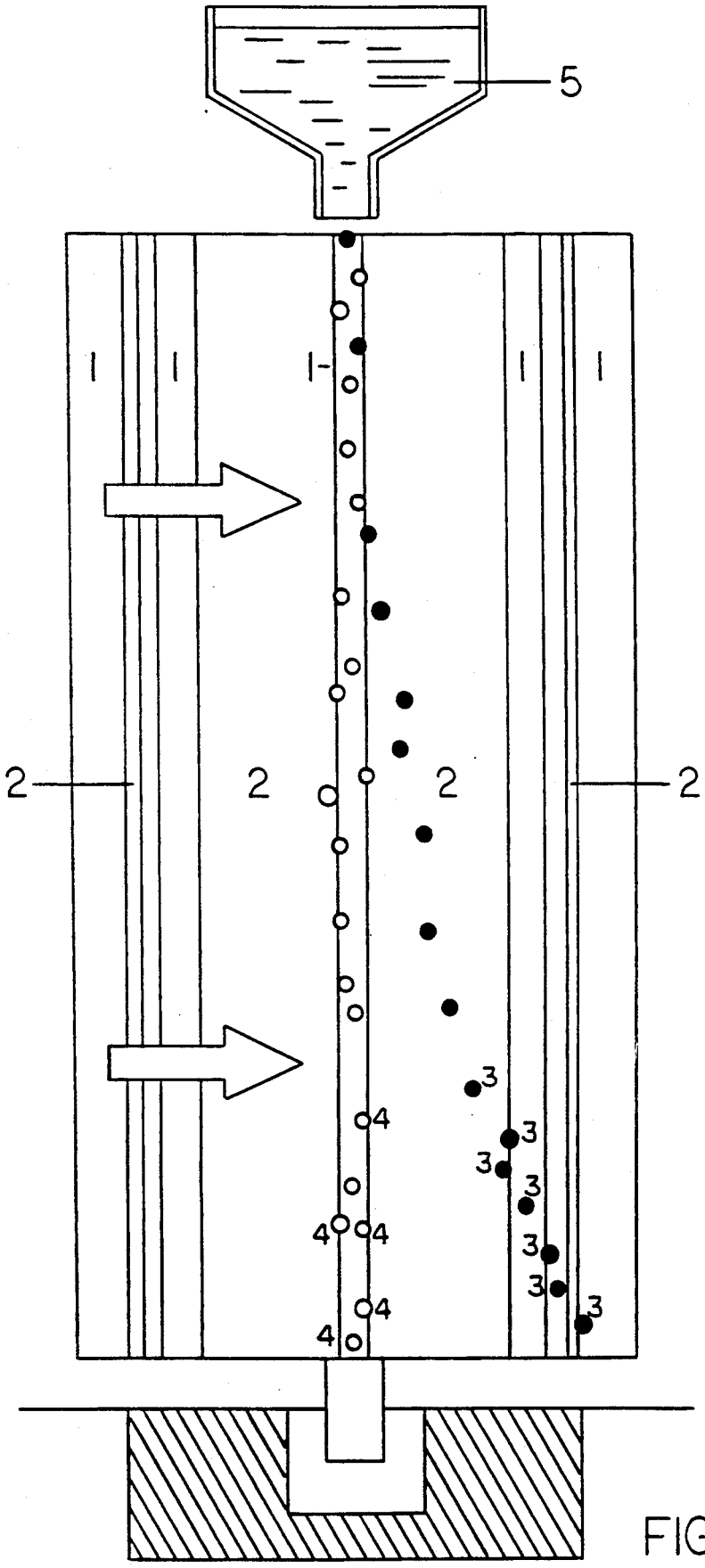
FIG. 3 further illustrates the principles of electrodynamic separation according to the invention and is a side view of a cylindrical tower of magnets.

If the disk in FIG. 2 is extended in the direction of its axis of rotation 5A, a cylinder results. If the once circular cross-section magnets are extended in the same manner, rails with a rectangular cross-section result. If the magnets, surfaces are made to extend above the surface of the cylinder, and the axis of rotation 5A is rotated 90 degrees, FIG. 3 results.

Proposed herein is a method of electrodynamic separation of non-ferromagnetic, free-flowing materials, based on interaction between time and space varying magnetic fields and eddy currents induced in electrically conductive particles of the material being separated.

The method is accomplished by feeding a flow of non-ferromagnetic free-flowing material into a region of space permeated by time and space varying magnetic fields produced by the rotation of a cylindrical tower or other rotating assembly of electromagnets or permanent magnets 1 (FIG. 3) with radially directed magnetic fields.

According to the invention, the flow of the free-flowing material being separated is fed into a region of maximum intensity of the time and space varying magnetic fields for inducing in electrically conducting particles 3 (FIG. 3) the maximum eddy currents deflecting the electrically conducting particles from the direction of feed of non-ferromagnetic particles 5 of the material being separated, which particles 5 may include the particles 3 and the particles 4.

Figure 4:
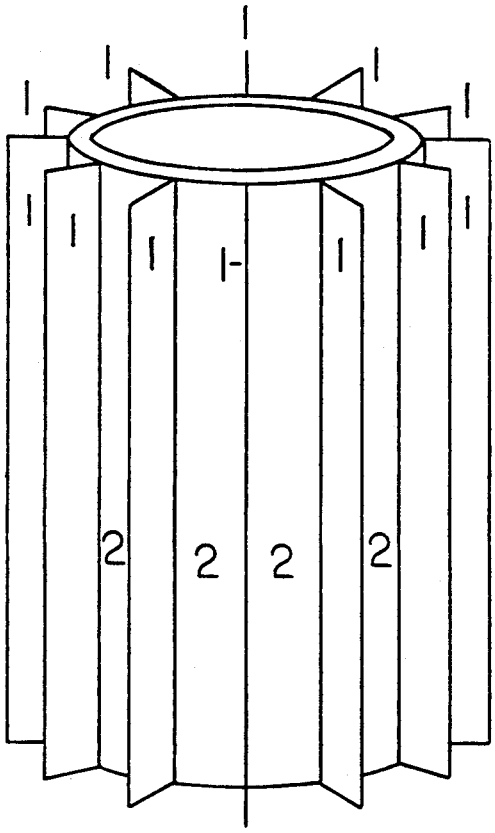
FIG. 4 is an oblique view of a cylindrical tower of magnets.
Figure 5:
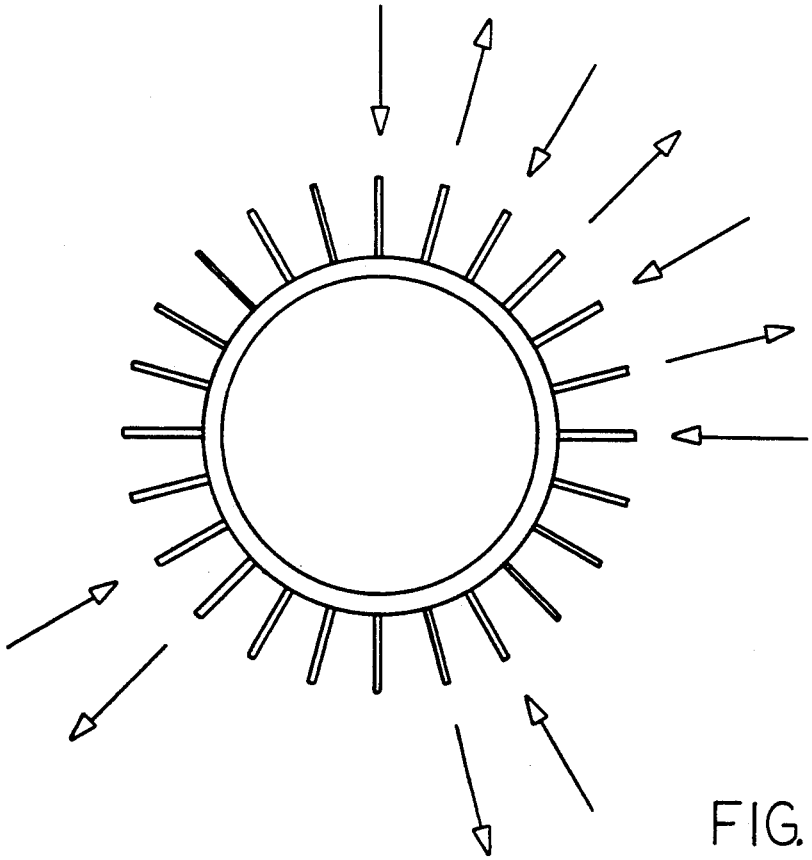
FIG. 5 is a top view of a cylindrical tower of magnets.
Figure 6:
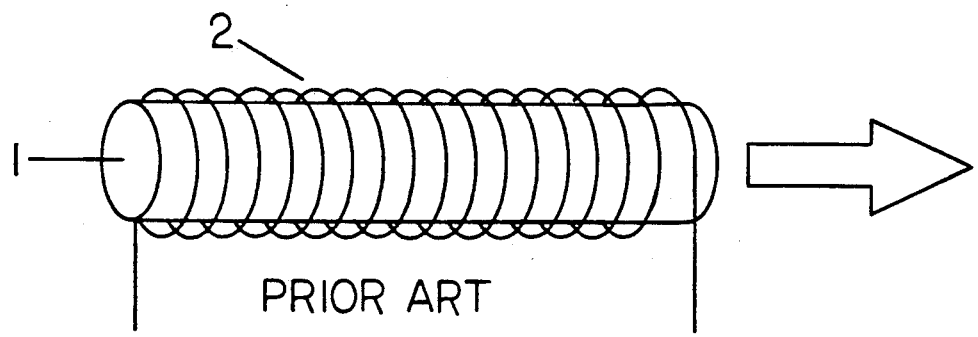
FIG. 6 is an illustration of a conventional solenoid showing electrically conductive wire wrapped around a ferromagnetic metal core.
Figure 7:
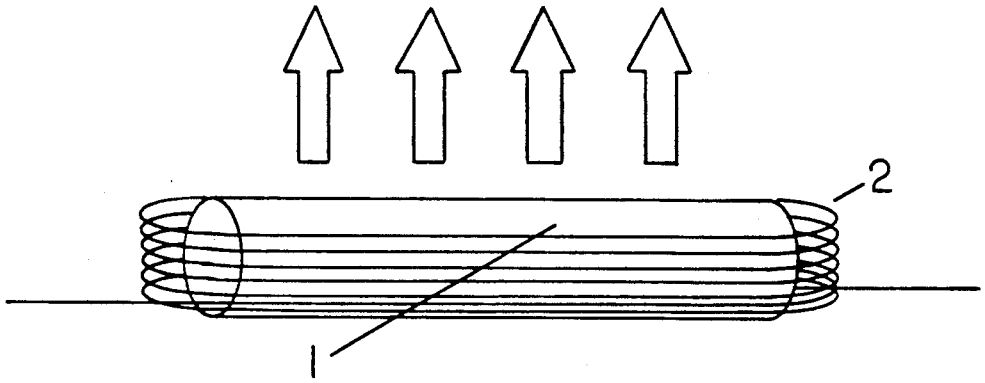
FIG. 7 is an illustration of a deviation from conventional electromagnet winding techniques in that the electromagnet is wound lengthwise or longitudinally.
Figure 8:
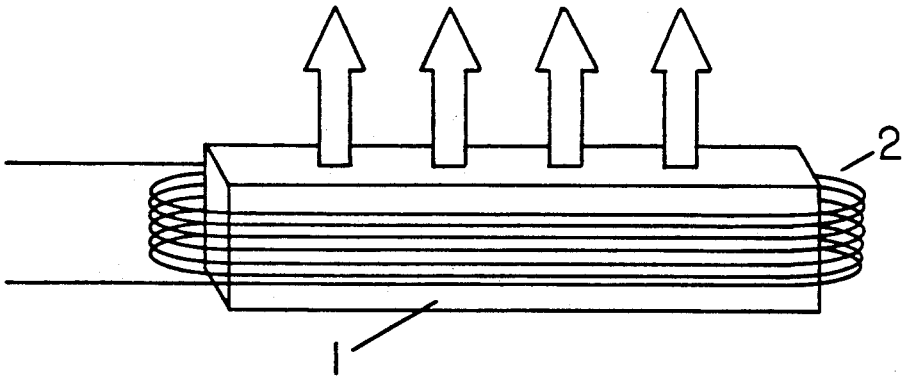
FIG. 8 is the same as FIG. 7, except the core of the material is of a rectangular cross-section.

The method of electrodynamic separation is effected by an electrodynamic separator. The electrodynamic separator is comprised of rotor assembly (FIG. 4) wherein the radial projections symbolize permanent magnets or electromagnets attached to said rotor assembly so that the associated magnetic fields are directed radially as in FIG. 5. The electromagnetics are formed as in FIG. 6, FIG. 7, or FIG. 8 in which the magnetic core 1 is wound with electrically conducting wire 2 in which alternating current or direct current flows. It is preferable, however, to excite said electromagnets with direct current. Furthermore, it is essential that the polarity of the magnetic fields of adjacent magnets positioned around the rotor whether permanent or electromagnet, or some combination thereof, alternate as illustrated in (FIG. 5).

Figure 9:
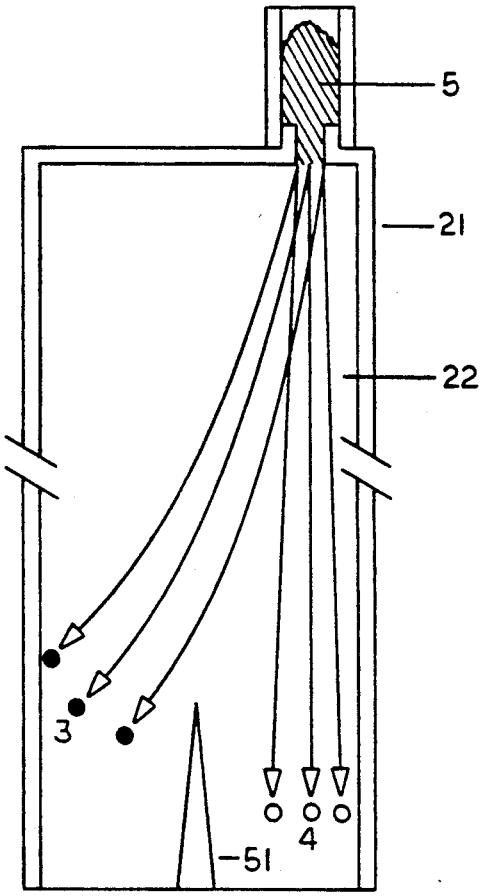
FIG. 9 is an illustration of a typical material processing chute, cut-away, side view delineating the trajectory of the segregated particles.

The non-ferromagnetic material to be processed (FIG. 9) is caused to fall into a region of space defined by the walls 21 of the processing chute 22, said chute 22 being located at the periphery of the circle described by the rotation of said rotor assembly, such that time and space varying magnetic fields of maximum intensity induce eddy currents in the conducting particles 3, deflecting said particles substantially from the free-fall trajectory of the non-ferromagnetic, nonconducting particles 4. A partition 51 suitably positioned in said chute physically segregates the conducting particles 3 from the nonconducting particles 4. A means is provided, not shown, for containing either or both components of the processed material.

Figure 10:
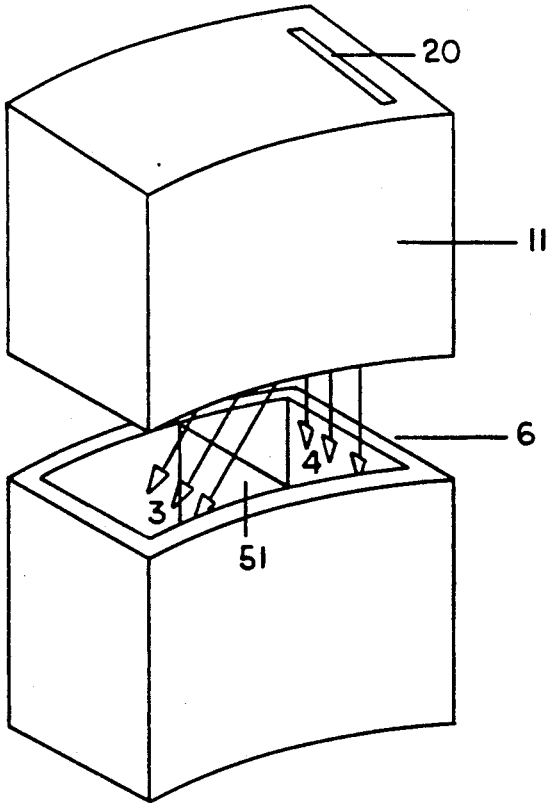
FIG. 10 is an oblique view of FIG. 9 illustrating a possible cross-sectional geometry for chute and entry orifice.
Figure 11:
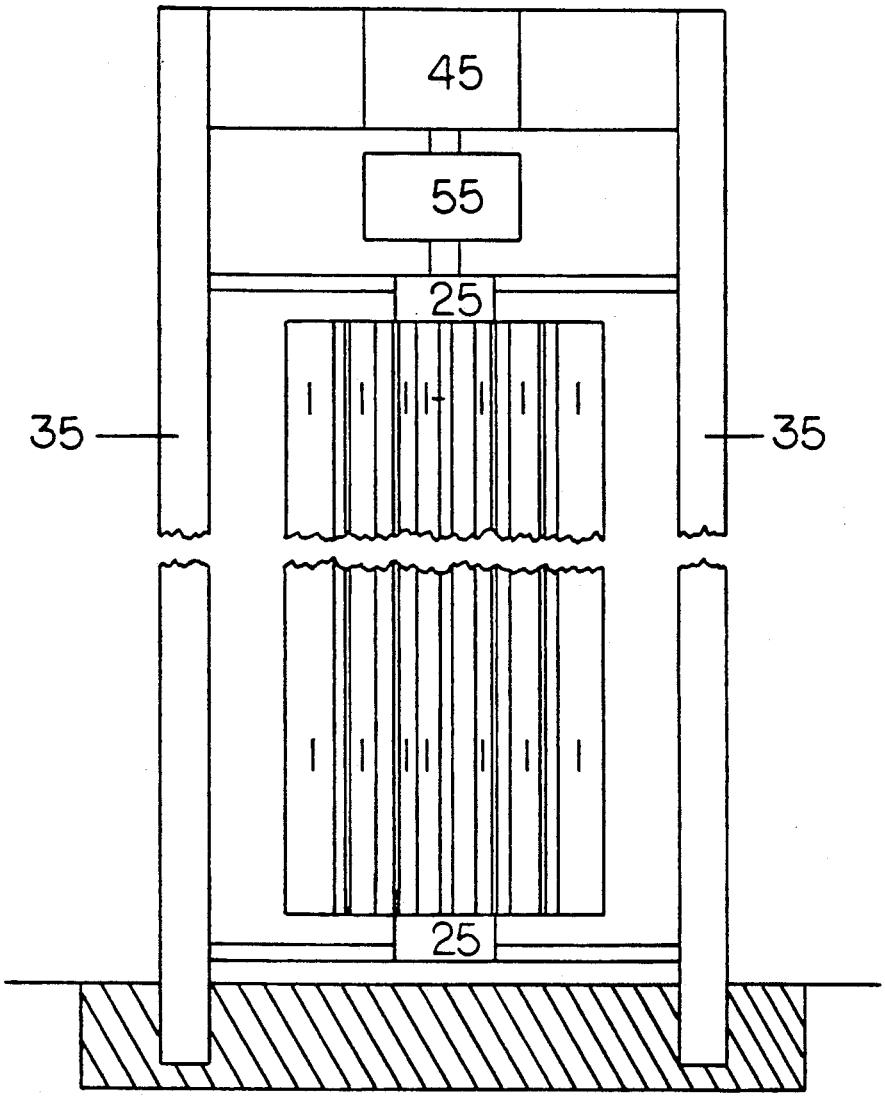
FIG. 11 is a side view illustration of the invention's essential components, with the exception of the processing chutes which were omitted for clarity.

The processing chute inner wall 11 (FIG. 10) through which the time and space varying magnetic fields must penetrate is composed of a material which is virtually transparent with respect to such fields such as plastic or other non-ferromagnetic material, permeable with respect to magnetic fields. The orifice 20 into which the material to be processed enters said chute 22 may be of any cross sectional geometry suitable for a particular application. However, it is preferable to utilize a geometry as in (FIG. 10) such that, with respect to said rotor, a tangentially narrow and radially wide curtain of material to be processed falls into said chute 22. Such an orifice requires of the magnetic fields the minimum amount of energy to effectively segregate the conducting particles 3 from the nonconductive particle free-fall trajectory 4. If the magnetic fields travel from left to right in FIG. 10, then partition 51 may be located a relatively short distance from the leading wall 6 and the stream of free- falling particles 4 in order to effect separation. The above consideration implies high throughput rates because narrow chutes 22 imply that a greater number of said chutes 22 can be positioned around the rotor's circumference.

Figure 12:
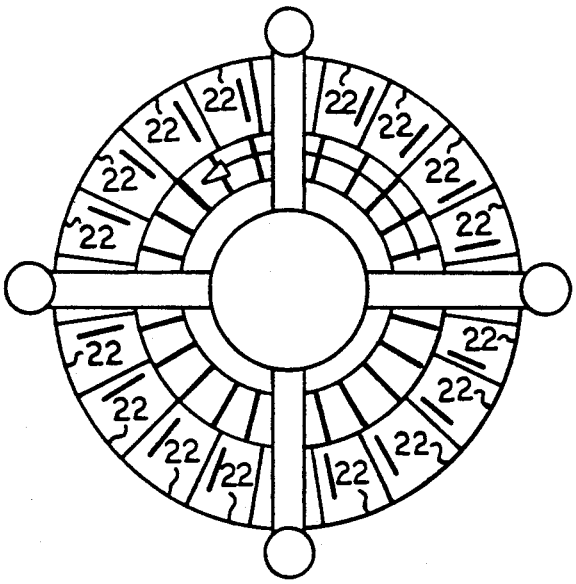
FIG. 12 is a top view illustration of FIG. 11 depicting the processing chutes not shown in FIG. 11.

The electrodynamic separator is comprised of a rotor assembly of permanent or electromagnets (FIG. and the means for stabilizing the shafts of said rotor by bearings 25. Said bearings are attached to a suitably rigid and tall frame 35 which houses said rotor assembly. Rotary motion is imparted to said rotor by a suitable electric motor or engine 45 or other prime mover device such as a wind actuated device, through a transmission 55, if required. At the periphery of rotation of the rotor assembly (FIG. 12) are processing chutes 22 into which the material to be processed falls.

While particular embodiments of the invention have been shown and described, various modifications thereof will be apparent to those skilled in the art and therefore it is not intended that the invention be limited to the disclosed embodiments or to the details thereof and departures may be made therefrom within the spirit and scope of the invention as defined in the claims.

What is claimed is:

1. A magnetic eddy-current separator for separating free-flowing particles of a first material from free-flowing particles of a second material based on differences in electrical conductivity between the first and second materials or differences in electrical conductivity, density and magnetic susceptibility of the first and second materials, said separator comprising:

rotor means having a generally cylindrical periphery for generating at least one time and space varying magnetic field that extends radially beyond said periphery, wherein the axis of said periphery extends vertically; and at least one means for defining a first free-fall flow path for the particles, said first flow path being thin in the direction of a tangent to said cylindrical periphery and wide in a direction extending radially from said cylindrical periphery, said first flow path being intersected by said at least one time and space varying magnetic field to cause the particles of the first material to move in the tangent direction out of said first fee-fall flow path into a second free-fall flow path to become separated from the particles of the second material.

2. A separator according to claim 1, further comprising:

said rotor means being designed for generating many of said time and space varying magnetic fields, said many fields being at closely spaced intervals around the entire extent of said periphery of said cylinder, and said at least one defining means comprising a plurality of said defining means at closely-spaced intervals around said periphery.

3. A separator according to claim 2, further comprising:

said rotor means being effective to move said magnetic fields relative to said plurality of defining means and create eddy-current forces extending in the tangent direction in which each said first flow path is thin; and partition means including partitions positioned around said periphery in closely-spaced relationship to each other for collecting the particles of the first material moved by said eddy-current force a relatively short tangential distance into each said second free-fall path.

4. A separator according to claim 1, further comprising:

means for isolating said first free-fall flow path from atmospheric forces while allowing said at least one magnetic field to intersect said first free-fall flow path.

5. A magnetic eddy-current separator for separating free-flowing particles of a first material from free-flowing particles of a second material based on differences in electrical conductivity between the first and second materials or differences in electrical conductivity, density and magnetic susceptibility of the first and second materials, said separator comprising:

means for defining a cylinder having a periphery from which a plurality of magnetic fields radially extend;

means for mounting said cylinder vertically;

means having a plurality of closely-spaced orifices for allowing the particles to move under the force of gravity along separate closely-spaced vertical first flow paths extending adjacent to said periphery of said cylinder, each of said orifices being thin in the direction of a tangent to said periphery and being wide in a direction extending radially outward from said periphery so that the flow path moving therefrom has a similar tangential thinness and radial width; and means for rotating said defining means so that said magnetic fields intersect each of said first flow paths of particles moving from said orifices and cause said magnetic fields to vary in time and space, said varying magnetic fields causing eddy-current forces to be applied to the particles moving along said separate vertical first flow paths, said eddy-current forces being in the direction of said tangential thinness of said first flow paths to cause the moving particles of said first material to move out of each of said first separate flow paths into second flow paths to separate the particles of the first material from the particles of the second material as the particles continue to move under the force of gravity.

6. A separator according to claim 5, wherein said rotating means causes air around said defining means to move and to normally exert non-gravitational forces on said moving particles in addition to the forces of gravity, further comprising:

means extending below each of said orifices for forming an enclosure into which the particles move from each of said respective orifices, each said enclosure being effective to prevent the air from exerting the non-gravitational forces on the particles in the flow path under the respective orifice.

7. A separator according to claim 6, further comprising:

said forming means forms said enclosures having tangential thinness and radial width corresponding to that of said respective orifices so that said enclosures are positioned in closely-spaced relationship; and a partition received in each of said enclosures for maintaining the separated particles of the first material apart from the particles of the second material;

said closely-spaced relationship of said enclosures allowing relatively high amounts of said particles to be separated.

8. A magnetic eddy-current separator adapted to separate free-flowing, nonferromagnetic, electrically conductive particles from free-flowing, nonferromagnetic, electrically nonconductive particles or to separate fee-flowing, nonferromagnetic, electrically conductive particles from one another based on differences in electrical conductivity, density, and magnetic susceptibility, comprising:

a plurality of openings for allowing the particles to free-fall, said openings being closely spaced along an annular path for forming said falling particles into a plurality of tangentially-narrow, wide radially-directed first streams of particles;

a chute for each of said first streams to isolate said first stream from air turbulence, each of said chutes being made of a material that will not obstruct the passage of magnetic fields;

partition means received in each said chute for defining at least one separate space adjacent to each of said first streams, each said separate space being positioned in the direction of said tangential narrowness of said first streams;

means for generating a vertically extending, radially-directed array of high intensity magnetic fields of such radial extent as to permeate the entire interior of each said chute, said magnetic fields alternating in polarity with the lines of force thereof extending in a direction generally parallel to said radially-directed first streams; and means for accelerating said particles falling in said first streams, said accelerating means comprising means for moving said magnetic fields at high velocity in the tangential direction to cut each said tangentially-narrow, radially-directed first stream of particles, whereby particles having higher conductivity are accelerated in said tangential direction and fall into one of said separate spaces.

* * * * *